US005271459A

United States Patent [19]

Daschmann

[11] Patent Number: 5,271,459

[45] Date of Patent: Dec. 21, 1993

[54] HEAT EXCHANGER COMPRISED OF INDIVIDUAL PLATES FOR COUNTERFLOW AND PARALLEL FLOW

[75] Inventor: Horst Daschmann, Ratingen, Fed. Rep. of Germany

[73] Assignee: Balcke-Dürr Aktiengesellschaft, Ratingen, Fed. Rep. of Germany

[21] Appl. No.: 992,707

[22] Filed: Dec. 18, 1992

[30] Foreign Application Priority Data

Dec. 20, 1991 [DE] Fed. Rep. of Germany ..... 9115813

[51] Int. Cl.[5] ..... F28F 3/08

[52] U.S. Cl. ..... 165/166; 165/165

[58] Field of Search ..... 165/165, 166, 167

[56] References Cited

U.S. PATENT DOCUMENTS

| | | | |
|---|---|---|---|
| 2,620,169 | 12/1952 | Gross et al. | 165/166 X |
| 4,042,018 | 8/1977 | Zebuhr | 165/166 |
| 4,148,357 | 4/1979 | Förster et al. | 165/166 X |
| 4,314,607 | 2/1982 | Des Champs | 165/166 |
| 4,503,908 | 3/1985 | Rosman et al. | 165/167 |

FOREIGN PATENT DOCUMENTS

| | | | |
|---|---|---|---|
| 3202578 | 1/1982 | Fed. Rep. of Germany . | |
| 3429491 | 8/1984 | Fed. Rep. of Germany . | |
| 4100940 | 1/1991 | Fed. Rep. of Germany . | |
| 95672 | 4/1971 | France . | |
| 144394 | 11/1981 | Japan | 165/166 |
| 647699 | 12/1950 | United Kingdom | 165/166 |
| 1395439 | 6/1973 | United Kingdom . | |
| 1468514 | 7/1973 | United Kingdom . | |

*Primary Examiner*—John Rivell
*Assistant Examiner*—L. R. Leo
*Attorney, Agent, or Firm*—Robert W. & Associates Becker

[57] ABSTRACT

A heat exchanger for counterflow and parallel flow is comprised of a plurality of stacks of form-stamped individual plates that are combined to pairs and the pairs are assembled atop one another to form the stacks. A first flow channel for a first medium is formed between the plates of each pair, and a second flow channel for the second medium is formed between adjacent pairs. The stacks are arranged directly adjacent to one another to form a stack assembly. Each first and second flow channel has an inlet and an outlet arranged diagonally opposite one another. The inlets and outlets of the first flow channels are arranged atop one another as are the inlets and the outlets of the second flow channels. The inlets and the outlets of the first flow channels are staggered relative to the inlets and outlets of the second flow channels by half a height of the pairs. Each stack has separating walls extending over the entire height of the stack for separating the inlets and outlets of the first flow channels from the inlets and outlets of the second flow channels. Cover plates connect the separating walls of neighboring stacks to form common collecting channels. The common collecting channels, including inlets and outlets at end faces of the stack assembly, are alternately connected to the inflow sockets and the outflow sockets of each medium so as to provide a separate flow passage for the first and the second medium.

4 Claims, 3 Drawing Sheets

HEAT EXCHANGER COMPRISED OF INDIVIDUAL PLATES FOR COUNTERFLOW AND PARALLEL FLOW

BACKGROUND OF THE INVENTION

The present invention relates to a heat exchanger comprised of individual plates for guiding media in counterflow and parallel flow.

Such heat exchangers are well known in the art and are comprised of form-stamped individual plates that are connected to form pairs which provide a first flow channel for a first medium. The pairs are connected to a pair stack thereby forming a second flow channel for the second medium. The inlets and outlets of each flow channels in the main direction of flow are diagonally oppositely arranged relative to one another. The inlets and outlets of the flow channels for the two media are arranged adjacent to one another, but are staggered by half the height of the pairs.

It is an object of the present invention to provide a heat exchanger of the aforementioned kind which is of a space-saving and compact construction and provides for a complete separation of the two media participating in the heat exchange while ensuring a low-loss pressure guidance of the media. It is another object of the present invention to provide identical modules for individually adapting the size of the heat exchanging surfaces and selecting suitable materials to fit a particular application, which modules allow for an easy access for maintenance purposes as well as a simple module exchange for repair purposes.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
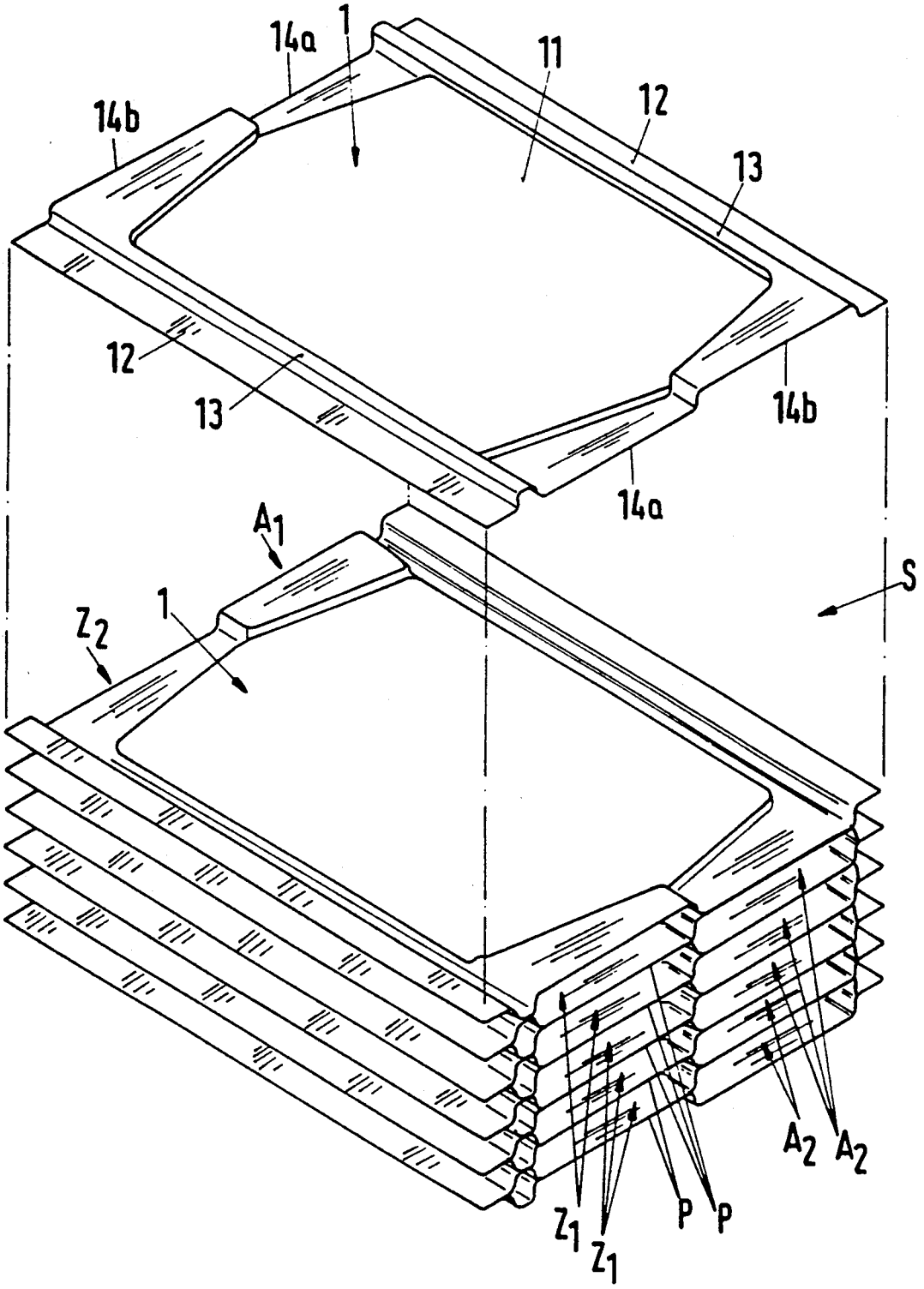
FIG. 1 is a perspective view of a portion of a stack comprised of a plurality of individual plates.

The heat exchanger for counterflow and parallel flow operation according to the present invention is primarily characterized by:

A plurality of stacks of form-stamped individual plates combined to pairs and the pairs assembled atop one another to form one stack, with first flow channels for a first medium being formed between the plates of one pair and with second flow channels for a second medium being formed between adjacent ones of the pairs, the stacks arranged directly adjacent to one another to form a stack assembly;

Each one of the first and second flow channels having an inlet and an outlet arranged diagonally opposite one another in the main flow direction;

The inlets and outlets of the first flow channels are arranged directly atop one another and the inlets and the outlets of the second flow channels are arranged directly atop one another, with the inlets and the outlets of a first flow channels staggered relative to the inlets and the outlets of the second flow channels by half a height of the pairs:

Each stack further comprises separating walls extending over the entire height of the stack for separating the inlets and outlets of the first flow channels from the inlets and outlets of the second flow channels;

Cover plates for connecting the separating walls of neighboring ones of the stacks to form common collecting channels; and A first inflow socket and a first outflow socket for the first medium and a second inflow socket and a second outflow socket for the second medium, with the common collecting channels, including the inlets and the outlets at end faces of the stack assembly, alternately connected to the first and second inflow sockets and the first and second outflow sockets so as to provide separate flow passages for the first medium and the second medium.

Due to this inventive embodiment of a counterflow or parallel flow heat exchanger comprised of individual plates a space-saving and compact construction results because the heat exchanging surface area is formed by a plurality of identical stacks (modules) of individual plates which are arranged directly adjacent to one another. With this embodiment the inventive heat exchanger requires the smallest possible base area because intermediate spaces for inflow and outflow of the heat exchanging media between the identical stacks of individual plates are eliminated. By varying the number of stacks of individual plates arranged adjacent to one another in the manner of modules, the size of the heat exchanging area can be adapted in a simple manner to any particular application.

Since each individual stack is comprised of form-stamped individual plates which are connected to pairs, the pairs connected to form the stack or module, the individual plates of the inventive heat exchanger can be simply adapted to particular applications by applying respective materials or coatings thereto so that the heat exchanger of the present invention can also be used for aggressive media or media that are laden with solid particles. Since one medium is guided into flow channels which are formed by assembling the pairs from individual plates and the other medium is guided through flow channels which are formed by connecting the pairs to a stack (module), an effective separation of the media participating in the heat exchange reaction is achieved so that especially polutant emissions due to leakage or solid material transport are prevented.

Since the media are guided in parallel flow or counterflow without deflection into the adjacently arranged stacks, the inventive heat exchanger operates with low pressure losses and with relative low gas velocities as well as without any drive and movable parts so that no additional noise emission is generated. Even when it is necessary to install an optional cleaning device, the commonly used sound proofing is sufficient without a further encasing of the heat exchanger being required.

The use of identical modules and a maximum of two different individual plates provides for an inexpensive manufacture and simple assembly. Furthermore, the adaptation of the heat exchanging surface area to the respective operational requirements is facilitated because the inventive heat exchanger can be varied on the one hand, by changing the number of individual plates forming a stack and, on the other hand, by changing the number of adjacently arranged stacks with respect to the desired heat exchanging efficiency.

By separating the inlets and outlets of each individual stack with the aid of separating walls extending over the entire height of each stack and by connecting these separating walls by cover plates to thereby form common collecting channels, favorable inflow and outflow conditions for the heat exchanging media are ensured with a simple construction with respect to the heat exchanging surface area formed by the stacks. Since the separating walls and the cover plates which form the common collecting channels can be easily removed, an easy access to the stacks for maintenance and repair purposes is provided whereby a repair of the heat exchanger is facilitated by the fact that an entire module may be exchanged. The collecting channels which are formed by the separating walls and the cover plates provide for a low-loss guidance and easy access and furthermore for the possibility of installing a cleaning device, if desired or necessary. This results in the advantage that the cleaning process can take place in the main direction of flow and the cleaning medium, for example, air, steam, or water, may be introduced from the top to flow in a vertical direction through the stack so that the collection of the cleaning medium laden with residues does not present a problem.

Since the collecting channels, including the inlets and outlets at the end faces of the stack assembly, are alternately connected to the inflow sockets, respectively, outflow sockets for the two media, the inventive heat exchanger provides for a plurality of possibilities for introducing and removing the heat exchanging media. According to a special embodiment of the present invention, the first inflow socket and the first outflow socket are positioned on a first end of the stack assembly, and the second inflow socket and the second outflow socket are positioned on a second end of the stack assembly. In the alternative, the first inflow socket and the first outflow socket are positioned on opposite ends of the stack assembly, and the second inflow socket and the second outflow socket are positioned on opposite ends of the stack assembly. The introduction and removal of each medium is therefore possible on the same side of the heat exchanger or on opposite sides of the heat exchanger resulting in a crossing of the media, independent of a counterflow or parallel flow of the media and independent of the introduction of the media from the top or the bottom.

In order to prevent dead space within the collecting channels formed by the separating walls and cover plates and provide a space-saving construction, it is furthermore suggested with the present invention to have cover plates that extend at a slant relative to the stacks.

DESCRIPTION OF PREFERRED EMBODIMENTS

The present invention will now be described in detail with the aid of several specific embodiments utilizing FIGS. 1 through 3.

FIG. 1 shows in a schematic perspective representation a first embodiment of a heat exchanger showing a stack S comprised of a plurality of form-stamped individual plates 1 which are connected to one another to form pairs P.

Each individual plate 1 has a bottom 11 that is positioned in a plane that is different from the plane of the longitudinal rim portions 12. Adjacent and parallel to these longitudinal rim portions 12 each individual plate 1 is provided with an abutment surface 13 which, relative to the longitudinal rim portion 12, is at a different level. This displacement between the abutting surface 13 and the corresponding longitudinal rim portion 12 is twice as great as the displacement between the longitudinal rim portion 12 and the bottom 11. The bottom 11 is thus positioned at the middle between the plane of the longitudinal rim portion 12 and the plane of the abutting surface 13.

The rim portions extending transverse to the longitudinal rim portions 12 of the individual plate 1 in the shown embodiment are positioned approximately half within the plane of the longitudinal rim portion 12 and half within the plane of the abutting surface 13. In this manner, transverse rim portions **14*a* and 14*b* are produced which with respect to their height (level) relative to the plane of the bottom 11 are displaced by the same amount relative to one another as the planes in which, on the one hand, the longitudinal rim portions 12 and, on the other hand, the abutting surfaces 13 are located. FIG. 1 shows clearly that the transverse rim portions 14*a* and 14*b* at either end of the plate 1** are arranged diagonally opposite one another.

Two of the individual plates 1, an exemplary one represented as the top portion in FIG. 1, are connected to form a pair P as can be seen in the representation at the bottom of FIG. 1. FIG. 1 shows five complete pairs P, whereby atop the uppermost pair P an individual plate 1 is arranged which can also be connected to the uppermost individual plate 1 spaced at a distance in the representation of FIG. 1 to form a pair P.

When the pairs P are connected within the area of the abutting surfaces 13 to form a stack S, flow channels result for the two media participating in the heat exchanging operation. The flow channels are arranged atop one another. While the first medium flows in flow channels which are formed between the pairs P, the second medium flows in the flow channels which result from combining the pairs P to the stack S. The transverse rim portions **14*a* of the individual plates 1 which are positioned in the plane of the longitudinal rim portions 12 form the inlet $Z_1$ and the outlet $A_1$ of the flow channels for the second medium flowing between the pairs P. The transverse rim portions 14*b* of the individual plates 1 located within the plane of the abutting surfaces 13 from the inlets $Z_2$ and outlets $A_2$ for the first medium which flows between the individual plates 1 of each pair P in the same direction as or counter to the direction of the second medium. FIG. 1 shows a counterflow heat exchanger and demonstrates that, due to the diagonally opposite arrangement of the inlets and outlets, the inlets $Z_1$, $Z_2$ for one medium are arranged adjacent to the outlets $A_2$, $A_1$ for the other medium and are staggered at half the height of a pair P. The heat exchanger, perspectively represented in FIG. 2, is operated in parallel flow with two media I and II whereby the medium I is, for example, the heat-delivering and the medium II the heat-receiving medium. The heat exchange between the two media I and II takes place in the stacks S which according to FIG. 1 are comprised of individual plates 1 connected to pairs P. These stacks S are arranged directly adjacent to one another so that their inlets $Z_1$, $Z_2$ are located vertically above the outlets $A_1$, $A_2$ as is shown in the cutout section of FIG. 2. The inlets and outlets corresponding to the two media I and II are diagonally oppositely arranged relative to one another as can be seen in FIG. 1**.

The inlets $Z_1$, $Z_2$ and outlets $A_1$, $A_2$ of each stack S are separated from one another by a separating wall 21 which extends over the entire height of the stack S. The separating walls 21 of neighboring stacks S are connected to one another by a cover plate 22 to form a common collecting channel 2. The collecting channels 2 in this manner provide an inflow or outflow for the media I and II of neighboring stacks S.

Figure 2:
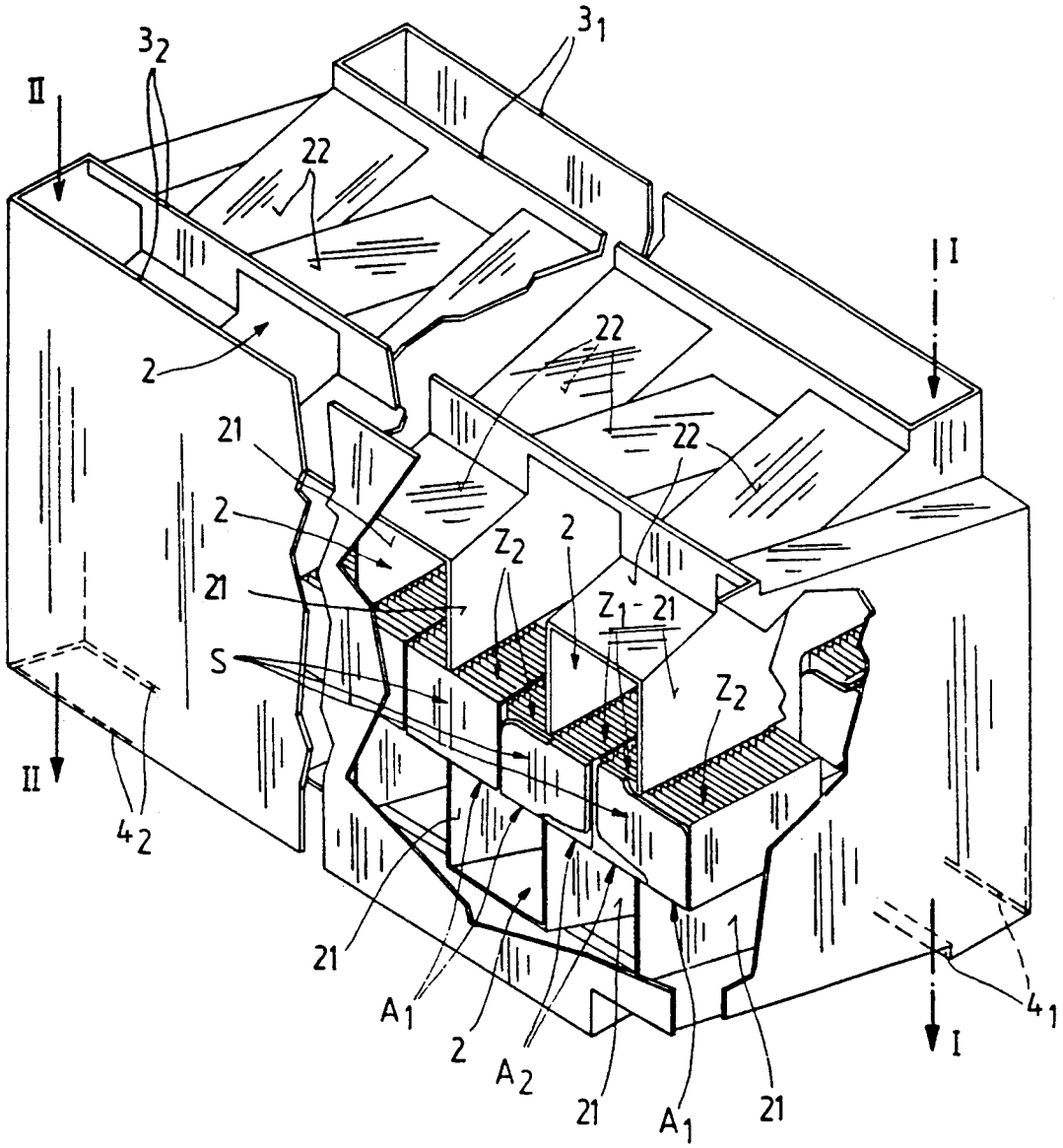
FIG. 2 is a perspective view of a heat exchanger comprised of stacks of individual plates according to FIG. 1 which is operated in counterflow.

The medium I, represented as a dash-dotted arrow, is introduced into the parallel flow heat exchanger of FIG. 2 from the top via the inflow socket $3_1$. This inflow socket $3_1$ is connected with those collecting channels 2 that open the inlets $Z_1$ of the stacks S. When flowing through neighboring stacks S the flow of the medium I is divided and guided into collecting channels 2 below the stacks S which guide the medium I to the outflow socket $4_1$ arranged below the inflow socket $3_1$ in the embodiment of FIG. 2.

The heat-receiving medium II enters the inflow socket $3_2$ from the top and is guided into the collecting channels 2 which lead to the inlets $Z_2$ of the stack S. The divided flows of the medium II, separated within the stacks S, are guided into the collecting channels 2 which lead to the outflow socket $4_2$ that is provided vertically below the inflow socket $3_2$. In order to prevent dead space and undesired turbulence within the heat exchanger, the cover plates 22 of the collecting channels 2 are slanted as shown in the upper part of FIG. 2.

Since the divided flows of the media I and II flow vertically from the top to the bottom, it is possible to clean the individual plates 1 forming the stacks S in the main flow direction, whereby not only a good cleaning effect, but also a simple removal of the cleaning medium is achieved. The parallel flow of the heat exchanging media demonstrated in the embodiment of FIG. 2 enables the generation of a surface temperature at the individual plates which prevents, on the one hand, the caking of solid particles thereat during entry of the media I and II into the stack S and, on the other hand, the temperature from falling below the due point. However, when caking does occur, this caked material can be collected and removed via the lower collecting channels 2 and the outflow sockets $4_1$ and $4_2$. The parallel flow discussed in connection with FIG. 2 has the further advantage that a constant temperature can be reached at the individual plates not only over the entire plate width but also over the entire plate length so that tensions caused by temperature differences are prevented. The heat exchanger represented in FIG. 2 is thus especially suitable for a recuperative heat exchange in connection with flue gas scrubbing devices.

Figure 3:
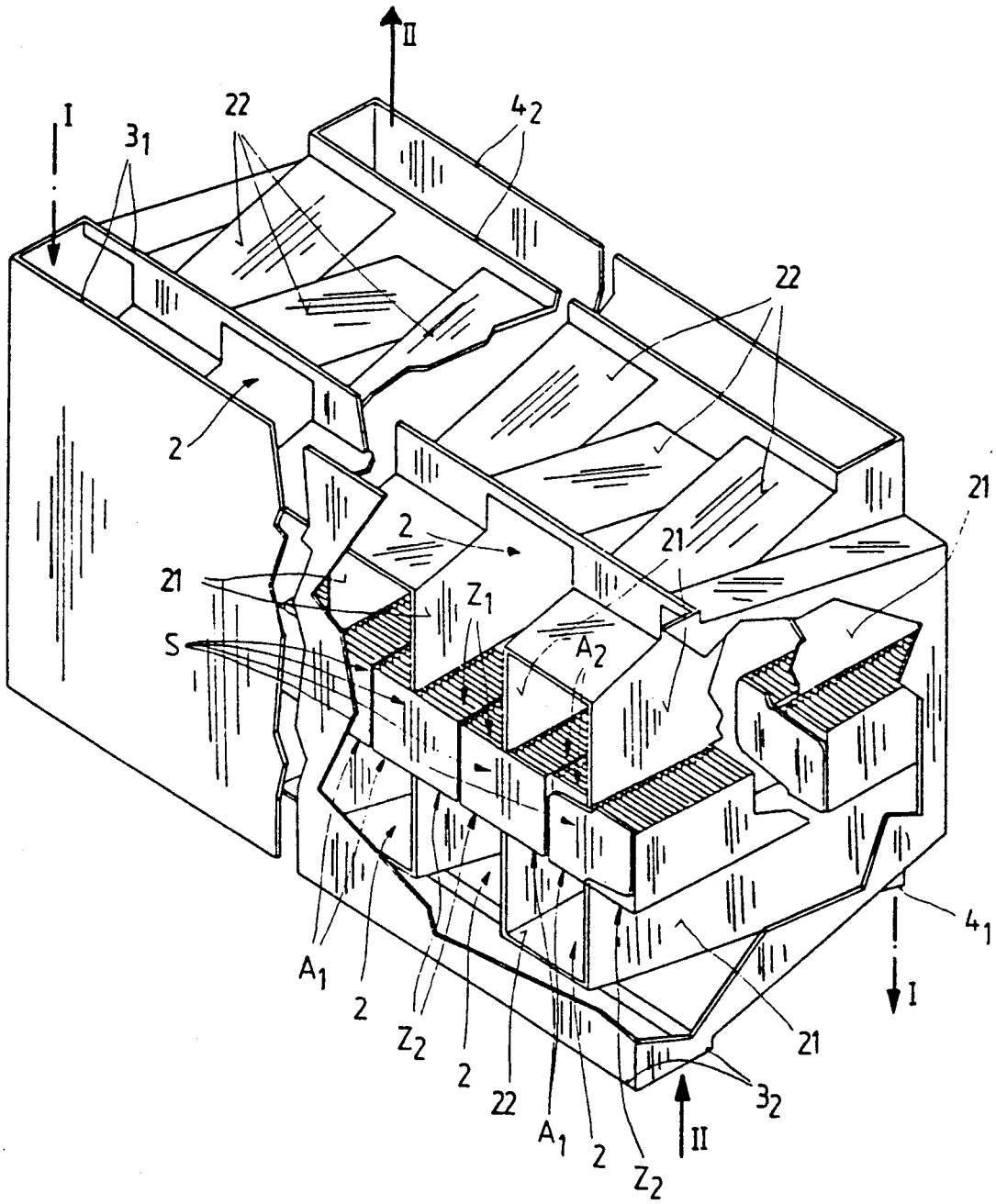
FIG. 3 shows a further embodiment of the heat exchanger in a perspective representation operated in parallel flow.

The heat exchanger according to FIG. 3 is a counterflow heat exchanger in which the heat-delivering medium I flows from the top according to the dash-dotted arrow into the inflow socket $3_1$ and from there into the collecting channels 2 connected with the inflow socket $3_1$. These collecting channels 2 which are formed by a separating wall 21 and a cover plate 22 are arranged above the inlets $Z_1$ of the plate stack S. The flow of heat-delivering medium I in this case is also divided and exits from the spaced outlets $A_1$ into the collecting channels 2 arranged below which are connected outflow socket $4_1$ located at the opposite end of the stack assembly.

The heat-receiving medium II enters from the bottom into the inflow socket $3_2$ and is guided via the corresponding collecting channels 2 to the inlets $Z_2$ provided at the bottom side of the stacks S. After the medium II has been heated within the stacks S, the medium II exits via the outlets $A_2$. It is then guided into the collecting channels 2 which are provided above these outlets $A_2$ and which are connected to the outflow socket $4_2$. The introduction and removal of the heat-receiving medium II is indicated with solid arrows in FIG. 3.

The representation of the heat exchangers in FIGS. 2 and 3 shows that despite a very compact and space-saving construction easy access to the stacks S is possible which not only facilitates the installation of cleaning devices, if desired, but also provides for an easy access with respect to repairs or maintenance. Furthermore, both representations show that the flow of the two media I and II takes the shortest possible path without a deflection that could cause a pressure loss so that the inventive heat exchanger despite its compactness has a high efficiency.

The present invention is, of course, in no way restricted to the specific disclosure of the specification and drawings, but also encompasses any modifications within the scope of the appended claims.

What I claim is:

1. A heat exchanger for counterflow and parallel flow operation, said heat exchanger comprised of:

a plurality of stacks of form-stamped individual plates combined to pairs and said pairs assembled atop one another to form one said stack, with first flow channels for a first medium being formed between said plates of one said pair and with second flow channels for a second medium being formed between adjacent ones of said pairs, said stacks arranged directly adjacent to one another to form a stack assembly;

each one of said first and second flow channels having an inlet and an outlet arranged diagonally opposite one another in said main flow direction;

said inlets and said outlets of said first flow channels arranged directly atop one another and said inlets and said outlets of said second flow channels arranged directly atop one another, with said inlets and said outlets of said first flow channels staggered relative to said inlets and said outlets of said second flow channels by half a height of said pairs;

each said stack further comprising separating walls extending over the entire height of said stack for separating said inlets and outlets of said first flow channels from said inlets and outlets of said second flow channels;

cover plates for connecting said separating walls of neighboring ones of said stacks to form common collecting channels; and a first inflow socket and a first outflow socket for the first medium and a second inflow socket and a second outflow socket for the second medium with said common collecting channels, including said inlets and said outlets at end faces of said stack assembly, alternately connected to said first and said second inflow sockets and said first and said second outflow sockets so as to provide separate flow passages for the first medium and the second medium.

2. A heat exchanger according to claim 1, wherein said first inflow socket and said first outflow socket are positioned on a first end of said stack assembly and wherein said second inflow socket and said second outflow socket are positioned on a second end of said stack assembly.

3. A heat exchanger according to claim 1, wherein said first inflow socket and said first outflow socket are positioned on opposite ends of said stack assembly and wherein said second inflow socket and said second outflow socket are positioned on opposite ends of said stack assembly.

4. A heat exchanger according to claim 1, wherein said cover plates extend at a slant relative to said stacks.

* * * * *